United States Patent [19]

Budinski et al.

[11] 3,948,045

[45] Apr. 6, 1976

[54] AIR CONTROL VALVE

[75] Inventors: John A. Budinski, Dayton; Wayne V. Fannin, Xenia; Raymond A. Flora, Dayton, all of Ohio

[73] Assignee: General Motors Corporation, Detroit, Mich.

[22] Filed: Apr. 21, 1975

[21] Appl. No.: 569,605

[52] U.S. Cl. ..... 60/290; 60/306; 137/612.1; 137/627.5; 417/504

[51] Int. Cl.[2] ..... F02B 15/10

[58] Field of Search ..... 60/289, 290, 306; 417/504; 137/612.1, 627.5

[56] References Cited

UNITED STATES PATENTS

| | | | |
|---|---|---|---|
| 3,805,522 | 4/1974 | Sheppard | 60/277 |
| 3,853,269 | 12/1974 | Graber | 137/627.5 |
| 3,869,858 | 3/1975 | Goto | 60/290 |

*Primary Examiner*—Douglas Hart
*Attorney, Agent, or Firm*—Robert M. Sigler

[57] ABSTRACT

An air control valve for directing the flow of air from an internal combustion engine driven pump and including differential pressure actuating means includes a pilot valve responsive to engine induction vacuum level to provide induction vacuum, atmospheric air or air from the pump to the actuating means. The pilot valve includes a chamber having openings communicating with the pump and the actuating means, a restricted orifice to atmosphere, a valve element capable of selectively closing either of the openings, a differential pressure motor actuated by induction vacuum and a tube projecting through the actuating means opening into the chamber, the tube being axially positionable by and in communication with the differential pressure motor to co-act with the valve member and openings to supply high pressure air, atmospheric air or induction vacuum to the actuating means according to the level of induction vacuum.

1 Claim, 3 Drawing Figures

AIR CONTROL VALVE

SUMMARY OF THE INVENTION

This invention is an air flow control valve for use in an emission control system for an internal combustion engine, and particularly for use in such an emission control system using both air injection into the exhaust manifold and a catalytic oxidizing converter.

It has been found, when using both an air injected exhaust manifold and a catalytic converter with the same engine, that, for efficient and trouble-free operation, it is sometimes advisable that the supply of air to one or both of these devices be cut off under certain engine operating conditions. For instance preventing injection of air into the exhaust manifold during engine deceleration or coasting will reduce the possibility of backfiring; while preventing injection of air into either the exhaust manifold or catalytic converter during acceleration will reduce the possibility of overheating in the catalytic converter. This invention is a valve which controls the flow of air from an air pump to the exhaust manifold and catalytic converter to prevent any such backfiring or overheating. Further details and advantages of this invention will be apparent in the accompanying figures and following description of a preferred embodiment.

DESCRIPTION OF A PREFERRED EMBODIMENT

Figure 1:
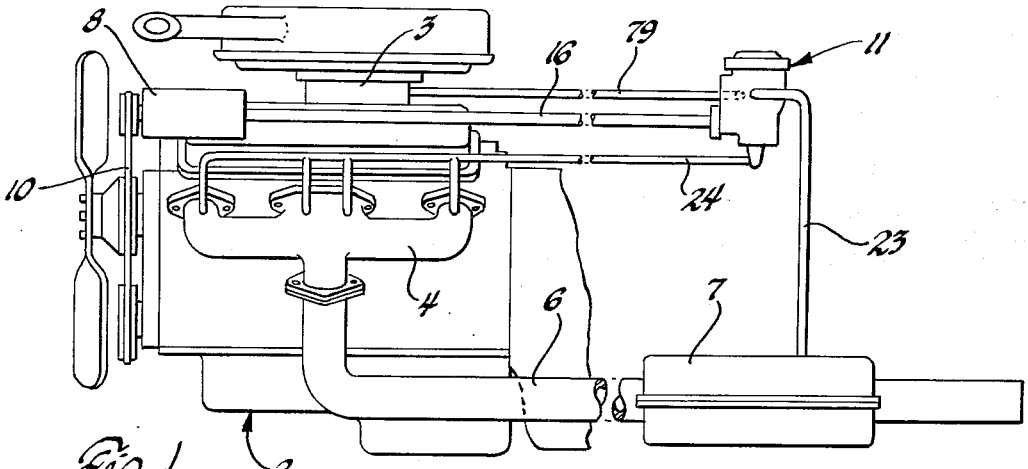
FIG. 1 shows a valve of this invention in its environment.

Referring to FIG. 1, an internal combustion engine 2 has an air induction system 3 and an exhaust system including an exhaust manifold 4, an exhaust pipe 6 and a catalytic oxidizing converter 7. Engine 2 drives an air pump 8 by means of drive belt 10.

Figure 2:
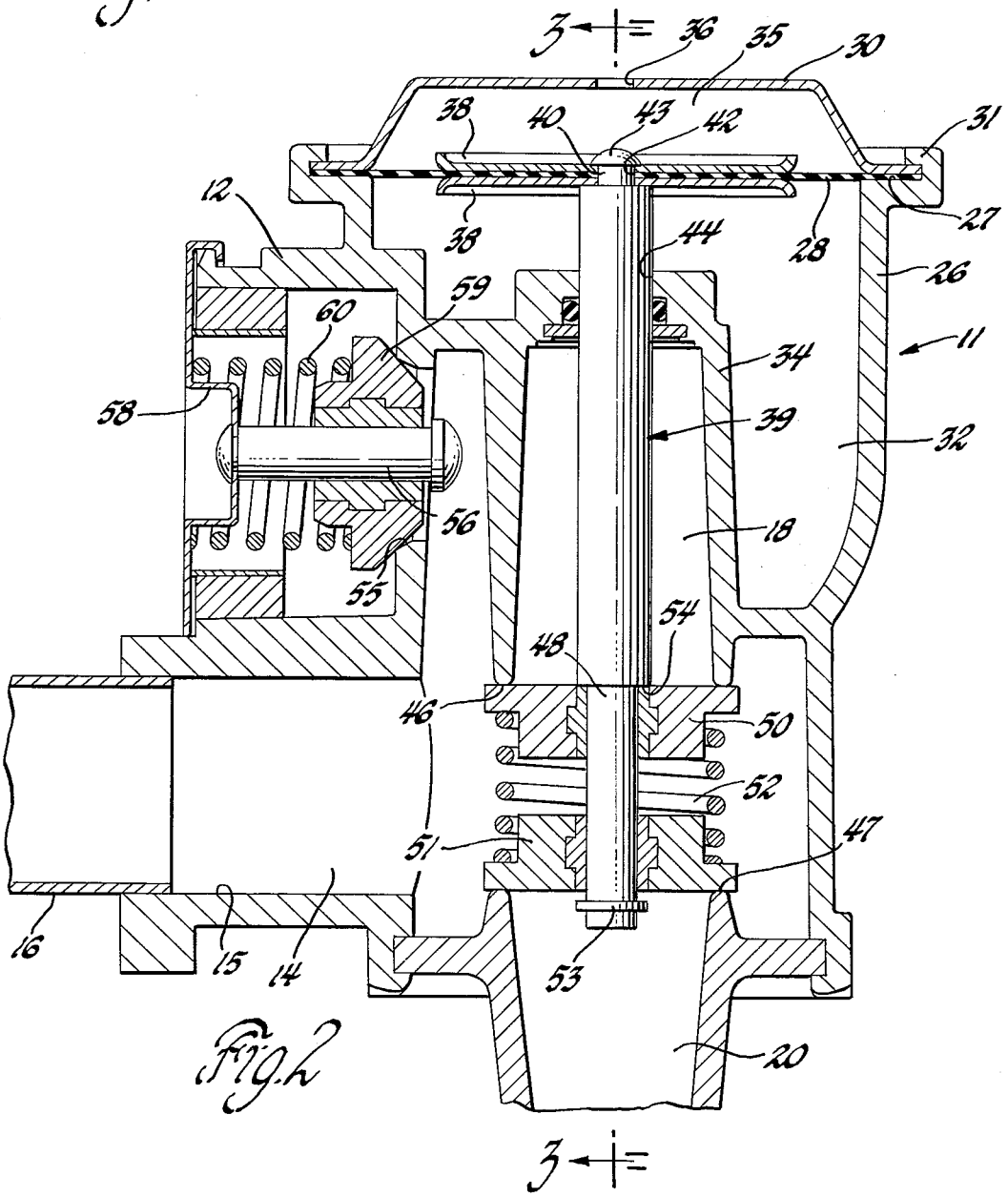
FIG. 2 is a cutaway view of a valve according to this invention.
Figure 3:
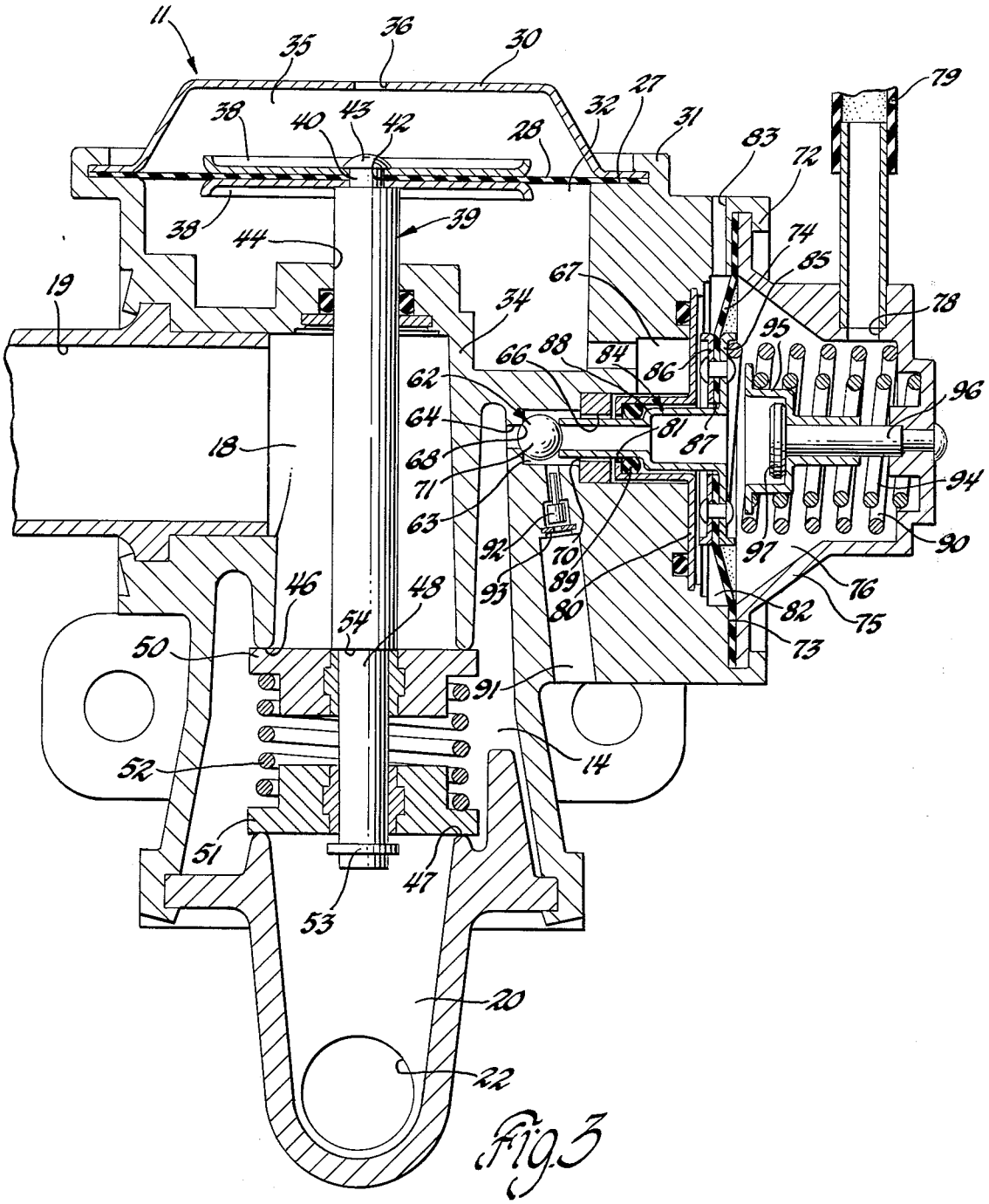
FIG. 3 is a view along line 3—3 in FIG. 2.

Referring to FIG. 2, an air control valve 11 comprises a valve body 12 defining an intake chamber 14 with an intake opening 15 in communication with air pump 8 through conduit 16, as seen in FIG. 1. Valve body 12 further defines, as seen in FIGS. 2 and 3, an upper outlet chamber 18 with an outlet opening 19 and a lower outlet chamber 20 with an outlet opening 22. As seen in FIG. 1, upper outlet chamber 18 communicates with exhaust manifold 4 through a conduit 24.

As shown in FIGS. 2 and 3, the outer wall 26 of valve body 12 defines a circular flanged seat 27. A flexible diaphragm 28 and an end cap 30 are disposed on seat 27; and the rim 31 of outer wall 26 is bent over end cap 30 to tightly retain end cap 30 and flexible diaphragm 28 in place. Diaphragm 28 and outer wall 26 help define an actuating chamber 32, which is further defined and separated from upper outlet chamber 18 by an internal wall 34 of valve body 12. Diaphragm 28 and end cap 30 form a chamber 35 above diaphragm 28, which chamber 35 is open to atmosphere through an opening 36 in end cap 30.

Diaphragm 28 is sandwiched between two support disks 38; and a valve stem 39 has a reduced diameter upper end 40 projecting through central openings 42 in the disks 38 and diaphragm 28, upper end 40 being formed to a rivet head 43 to hold disks 38 and diaphragm 28 tightly to valve stem 39.

Valve stem 39 projects downward from diaphragm 28 through an opening 44 in internal wall 34, through upper outlet chamber 18, through a valve seat 46 defining an opening between upper outlet chamber 18 and intake chamber 14, through intake chamber 14 and through a valve seat 47 defining an opening between intake chamber 14 and lower outlet chamber 20. Slidably mounted on a reduced diameter lower portion 48 of valve stem 39 are a pair of valve members 50 and 51. A coil spring 52 compressed between valve members 50 and 51 normally biases valve member 50 against the valve seat 46 and valve member 51 against valve seat 47 when diaphragm 28 is in a central position. A circumferential shoulder 54 at the upper end of lower portion 48 of valve stem 39 is effective, upon downward movement of valve stem 39 to move valve member 50 downward away from valve seat 46 and thereby open chamber 18 in communication with chamber 14. Likewise, a stop 53 on valve stem 39 below valve member 51 is effective, upon upward movement of valve stem 39, to move valve member 51 away from valve seat 47 and thereby open chamber 14 in communication with chamber 20.

Valve body 12 further includes a valve seat 55 defining an opening between intake chamber 14 and the atmosphere. A valve stem 56, which is fixed to a stamped plate 58 attached to valve body 12, carries a sliding valve member 59 which is normally biased against valve seat 55 by a coil spring 60. Valve member 59 and coil spring 60 comprise the usual pressure relief valve used with engine driven air pumps in air injection systems.

The pressure in actuating chamber 32 is controlled by a pilot valve generally indicated as 62 in Figure 3. Valve body 12 defines a chamber 63 with an opening 64 therefrom into intake chamber 14 and another opening 66 therefrom into a passage 67 leading to actuating chamber 32. Valve body 12 defines a valve seat 68 surrounding opening 64 and a valve seat 70 surrounding opening 66; and a spherical valve member 71 of diameter greater than valve seats 68 and 70 is loosely contained within chamber 63. Valve member 71 is capable of closing either of openings 64 or 66 but not both simultaneously.

Valve body 12 defines an annular seat 73 and a flange 72 crimped over a flexible diaphragm 74 and cover member 75 to retain them against seat 73. Cover member 75 and diaphragm 74 define an induction vacuum chamber 76 in communication with induction vacuum source 3 through an opening 78 in cover member 75 and a conduit 79. On the opposite side of diaphragm 74 from induction vacuum chamber 76, diaphragm 74, valve body 12 and a stamped plate 80 define a chamber 82 open to the atmosphere through an opening 83 in valve body 12. A flanged tube 84 has a flange portion 85 in chamber 76 riveted through diaphragm 74 to an annular disc 86 in chamber 82. Tube 84 projects through an opening 87 in diaphragm 74, through the center of annular disk 86 and through an opening 81 in plate 80 into opening 66. A circumferential shoulder 88 in tube 84 retains a sealing O-ring 89 between tube 84 and stamped plate 80 to seal opening 81. Tube 84 is of a diameter small enough to allow communication through opening 66 between chambers 63 and 82 and to be capable of being closed by valve member 71.

A coil spring 90 in induction vacuum chamber 76 bears against flange portion 85 of tube 84 to bias the other end of tube 84 into chamber 63. Spring 90 is effective, when manifold vacuum in chamber 76 is low, to cause tube 84 to bias valve member 71 against valve seat 68 in chamber 63 so that chamber 63 is cut off from both intake chamber 14 and manifold chamber 76. A passage 91 is provided communicating chamber 63 with the atmosphere. A loosely fitting plug 92 and an annular disk 93 retaining plug 92 in passage 91 comprise a restricted orifice by which chamber 63 communicates at all times with the atmosphere.

Another coil spring 94, coaxial and contained within coil spring 90, biases a sliding stop 95 outward on a shaft 96 against a flange 97 as seen in FIG. 3. Spring 94, stop 95, shaft 96 and flange 97 are so designed that, when tube 84 is in the low vacuum position, shown in FIG. 3, stop 95 does not contact flange portion 84. It is close enough to flange portion 84, however, to contact it soon after tube 84 begins to move to the right with increasing induction vacuum in chamber 76. Both coil spring 90 and 94 are somewhat compressed in the low induction vacuum position shown in FIG. 3, the degree of compression of each spring affecting and actuating vacuum levels of the pilot valve 62.

In operation, under low induction vacuum supplied to chamber 76, the valve is as shown in FIGS. 2 and 3. Valve member 71 closes intake chamber 14 and induction vacuum chamber 76 from chamber 63, which is open to atmosphere through restricted passage 91. The atmospheric pressure in chamber 63 is communicated through passage 67 to actuating chamber 32, where it is balanced against the constant atmospheric pressure in chamber 35. Diaphragm 28, subjected to atmospheric pressure on both sides, maintains valve stem 44 in its central position; and valve members 50 and 51 close openings 46 and 47. Air from pump 8 in intake chamber 14 opens valve 59 and is vented to atmosphere through opening 55.

As induction vacuum supplied to chamber 76 increases, the pressure differential across diaphragm 74 increases; but at first, due to the compression of spring 90, tube 84 does not move. When induction vacuum in chamber 76 reaches a first predetermined level, however, tube 84 is moved to the right from the position shown in FIG. 3, thus removing the bias of valve member 71 against valve seat 68. The air pressure within intake chamber 14 against valve member 71 and the induction vacuum within tube 84 applied against another portion of the surface of valve member 71 cause valve member 71 to move to the right against the end of tube 84. Pressurized air from intake chamber 14 flows through opening 64, chamber 63 and passage 67 into actuating chamber 32, where it acts on diaphragm 28 to raise valve stem 44 and open valve member 51 to allow pressurized air from intake chamber 14 to flow through lower outlet chamber 20, outlet opening 22 and conduit 24 to exhaust manifold 4. Some pressurized air escapes from chamber 63 through restricted opening 91, but the amount is negligible. As induction vacuum increases further, tube 84 continues to move to the right from its position in FIG. 3 until flange portion 85 abuts stop 95. Due to the precompression of spring 94, tube 84 remains in this position with opening 64 open but tube 84 closed by valve member 71 until a second predetermined induction vacuum level is reached in chamber 76. As induction vacuum increases from the second predetermined level, tube 84 resumes its rightward movement and valve member 71 engages valve seat 70, where it is retained by the force of pressurized air in chamber 63 to close chamber 63 from passage 67. Tube 84 pulls away from valve member 71, and induction vacuum from chamber 76 is supplied through tube 84 and passage 67 to actuating chamber 32. Under the new conditions, stem 44 is pushed downward to open valve member 50 and allow air flow from intake chamber 14 through upper outlet chamber 18, outlet opening 19 and conduit 23 to catalytic converter 7.

Upon resumption of the low manifold vacuum condition from either of the others, restricted passage 91 allows atmospheric pressure to be established once again in chamber 32.

Thus it can be seen that pilot valve 62 controls the position of air control valve 11 among three positions, each of which corresponds to a different range of induction vacuum. With induction vacuum below a first predetermined level, corresponding to engine acceleration under wide open throttle, air from pump 8 is vented to atmosphere. With induction vacuum between the first predetermined level and a higher second predetermined level, the normal driving range of a vehicle powered by engine 2, air from pump 8 is supplied to the exhaust manifold 4 for oxidation of hydrocarbons and carbon monoxide therein. Finally, with manifold vacuum greater than the second predetermined level, as in high speed deceleration, air from pump 8 is supplied to the catalytic converter to help prevent its overheating.

Although the preferred embodiment of this invention has been described, equivalent embodiments will occur to those skilled in the art; and the scope of this invention should be restricted only by the claim which follows.

The embodiments of the invention in which an exclusive property or privilege is claimed are defined as follows:

1. In a valve for controlling the destination of high pressure air from a pump driven by an internal combustion engine, the engine having air and fuel induction means including a source of induction vacuum, the control valve including means for selecting among a plurality of outlets and a first differential pressure motor for actuating said selection means according to the pressure supplied to it; a pilot valve assembly comprising:

a housing defining a valve chamber, a first opening communicating the valve chamber with the pump and defining a first valve seat in the valve chamber, a second opening communicating the valve chamber with the first differential pressure motor and defining a second valve seat in the valve chamber and means providing restricted communication between the valve chamber and the atmosphere; a valve member within the valve chamber; a second differential pressure motor having an actuating chamber in communication with the source of induction vacuum and an output member comprising a tube having one end in communication with the actuating chamber, having a free end projecting through the second opening into the valve chamber and being adapted for axial movement with changing induction vacuum; the second differential pressure motor being adapted, with induction vacuum below a first predetermined level, to position the tube with its free end holding the valve member against the first valve seat, whereby the tube and first opening are closed and the first differential pressure motor is open to atmospheric air through the second opening and restricted communication means, the second differential pressure motor further being adapted, with induction vacuum between the first and a second high predetermined level, to pull the tube away from its first opening closing position, whereby the valve member, due to differential air pressure, moves with and closes the free end of the tube and high pressure air is thereby communicated to the first differential pressure motor through the first and second openings; the second differential pressure motor further being adapted, with induction vacuum greater than the second predetermined level, to withdraw the free end of the tube from the valve chamber past the second valve seat, whereby the valve member, due to differential air pressure, is lodged in the second valve seat to close the second opening and is separated from the free end of the tube, whereby induction vacuum from the second differential pressure motor is communicated to the first differential pressure motor through the tube.

* * * * *